US006304030B1

(12) United States Patent
Driessens et al.

(10) Patent No.: US 6,304,030 B1
(45) **Date of Patent: *Oct. 16, 2001**

(54) LOW-PRESSURE MERCURY VAPOR DISCHARGE LAMP

(75) Inventors: Rene M. A. Driessens; Pieter C. Ooms, both of Terneuzen (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/314,417

(22) Filed: May 18, 1999

(30) Foreign Application Priority Data

May 22, 1998 (EP) ..... 98201705

(51) Int. Cl.[7] ..... H01J 17/26

(52) U.S. Cl. ..... 313/566; 313/565; 313/564; 313/550; 313/556

(58) Field of Search ..... 313/563, 564, 313/565, 566, 484, 485, 490, 491, 493, 550

(56) References Cited

U.S. PATENT DOCUMENTS

| | | | | |
|---|---|---|---|---|
| 3,619,697 | * | 11/1971 | Evans | 313/490 |
| 3,629,641 | * | 12/1971 | Hofmann et al. | 313/490 |
| 4,105,910 | * | 8/1978 | Evans | 313/490 |
| 4,977,349 | * | 12/1990 | Asakura et al. | 313/490 |
| 5,055,738 | * | 10/1991 | Yorifuji et al. | 313/490 |
| 5,204,584 | * | 4/1993 | Ikeda et al. | 313/565 |
| 5,828,170 | * | 10/1998 | Nishio et al. | 313/493 |
| 5,841,220 | * | 11/1998 | Ooms | 313/563 |
| 5,907,216 | * | 5/1999 | Ligthart et al. | 313/564 |

FOREIGN PATENT DOCUMENTS

| | | | |
|---|---|---|---|
| 0797239 | 3/1997 | (EP) | H01J/61/54 |
| 1115048 | of 1989 | (JP) | H01J/61/28 |
| 1146244 | of 1989 | (JP) | H01J/61/28 |

* cited by examiner

*Primary Examiner*—Nimeshkumar D. Patel
*Assistant Examiner*—Mariceli Santiago
(74) *Attorney, Agent, or Firm*—Norman N. Spain

(57) ABSTRACT

A low-pressure mercury vapor discharge lamp with a discharge vessel (10) having first and second end portions (11). The discharge vessel encloses a discharge space provided with a filling of mercury and an inert gas in a gastight manner. Each end portion (11) supports an electrode (20) which is arranged in the discharge space and secured to current supply conductors (30A, 30B) which are passed through the end portion (11) so as to project outside the discharge vessel (10). A segment (31A) of at least one current supply conductor (30A), which extends between the end portion (11) and the electrode (20), is covered with an amalgam. The region (35A) is situated at a distance $d_a$ from the end portion (11). The amalgam can be relatively easily applied in the discharge lamp according to the invention.

7 Claims, 2 Drawing Sheets

LOW-PRESSURE MERCURY VAPOR DISCHARGE LAMP

BACKGROUND OF THE INVENTION

The invention relates to a low-pressure mercury vapor discharge lamp comprising a discharge vessel, which discharge vessel encloses a discharge space containing a filling of mercury and an inert gas in a gastight manner, an electrode being arranged at each end portion in the discharge space for generating and maintaining a discharge in the discharge space, current supply conductors of the electrodes extending through the end portions so as to project from the discharge vessel, and at least one of the current supply conductors carrying an amalgam.

In mercury-vapor discharge lamps, mercury constitutes the primary component for (efficiently) generating ultraviolet (UV) light. An inner wall of the discharge vessel may be coated with a luminescent layer comprising a luminescent material (for example a fluorescent powder) for converting UV light to other wavelengths, for example UV-B and UV-A for tanning purposes (sunbed lamps) or to visible radiation. Such discharge lamps are therefore also referred to as fluorescent lamps.

A low-pressure mercury vapor discharge lamp of the type mentioned in the opening paragraph is known from U.S. Pat. No. 4,105,910. In the known discharge lamp, the current supply conductor carries an amalgam which is provided on a metal plate which is secured to the current supply conductor. This amalgam acts as an auxiliary amalgam and serves to increase the run-up rate, that is the rate at which the discharge lamp approximates its rated light intensity after having been switched on. This is achieved by the fact that, after switching-on the lamp, heat originating from the electrode causes the amalgam to give off the mercury bonded thereto, thereby causing the mercury vapor pressure in the discharge vessel to increase to a value which is desired for nominal operation. This has the drawback, however, that the plate entails extra costs due to its manufacture, storage, transport and assembly with other parts of the discharge lamp.

SUMMARY OF THE INVENTION

It is an object of the invention to provide a low-pressure mercury vapor discharge lamp which more rapidly reaches its rated light intensity. The invention further aims at providing a low-pressure mercury vapor discharge lamp which can be manufactured more economically.

In accordance with the invention, characterized in that the amalgam covers a region of a segment of the current supply conductor, which segment connects the end portion to the electrode, and which region is situated at a distance $d_a$ from the end portion, where $d_a>0$.

Since the amalgam is provided on the current supply conductor at a location relatively close to the electrode, the heat generated in the electrode after the lamp has been switched on is better, and more rapidly, dissipated to the amalgam, so that the warming-up time of the amalgam is reduced, causing the mercury vapor pressure in the discharge space to increase more rapidly, and hence the value of the mercury vapor pressure desired for nominal operation to be reached sooner.

In the low-pressure mercury vapor discharge lamp disclosed in U.S. Pat. No. 4,105,910, a region of the (glass) end portion of the discharge vessel is coated with amalgam. The coating also extends over a region of a current supply conductor which borders on the end portion. At the end of the service life of the lamp, the amalgam constitutes a point of action for the discharge arc. At this stage, the end portion of the discharge vessel is strongly heated, causing it to melt so that air can flow into the discharge vessel and the operation of the lamp is interrupted.

In the low-pressure mercury vapor discharge lamp known from U.S. Pat. No. 5,841,220, the region coated with amalgam extends from a free end portion of the current supply conductor. For this purpose, the current supply conductor is extended relative to the location on the current supply conductor where the electrode is secured. In the discharge lamp in accordance with the invention, the current supply conductor does not have to be extended to reach the desired temperature of the amalgam, because the amalgam is provided on a segment of the current supply conductor which extends between the end portion and the electrode.

The temperature reached by the amalgam during operation of the lamp can be selected by means of the position of the region relative to the electrode. A preferred embodiment of the low-pressure mercury vapor discharge lamp in accordance with the invention is characterized in that the distance $d_a$ meets the relation:

$$0.05\times d_{ep\text{-}e} \leqq d_a \leqq 0.9\times d_{ep\text{-}e},$$

where $d_{ep\text{-}e}$ is a distance between the end portion and the electrode, and the distance $d_a$ being measured from the end portion.

The lower limit of the distance ($d_a \geqq 0.05\times d_{ep\text{-}e}$) is determined because it is desirable for the amalgam to be positioned not too close to the end portion since this adversely affects the warming-up of the amalgam after switching on the lamp. In the lamp known from U.S. Pat. No. 4,105,910, a region of the end portion is coated with amalgam, which is unfavorable for a rapid warming-up of the amalgam. The upper limit of the distance ($d_a \leqq 0.90\times d_{ep\text{-}e}$) is determined because it is desirable to position the amalgam not too close to the electrode since this has an unfavorable effect on the amalgam if the lamp is in operation for a long period of time. In this manner, it is further precluded that amalgam finds it way to the electrode, which would hamper the electron-emitting effect of the electrode. In addition, if amalgam would find its way to the electrode, it could spread further in the discharge vessel from the electrode, which generally adversely affects the mercury vapor pressure. A suitable temperature of the auxiliary amalgam is obtained, in particular, if $0.1\times d_{ep\text{-}e} \leqq d_a \leqq 0.5\times d_{ep\text{-}e}$.

In an attractive embodiment, the amalgam-coated regions of the current supply conductors occupy mutually different positions relative to the electrode. Partly as a result thereof, the auxiliary amalgams thus formed give off mercury at different time intervals after switching on the lamp. In this manner, a temporary excess or shortage of mercury after switching on the lamp can be counteracted.

Preferably, the amalgam is provided directly on the segment of the current supply conductor. This results in a reduction of the number of components of the discharge lamp, so that the discharge lamp can be manufactured more economically. In the discharge lamp known from U.S. Pat. No. 4,105,910, the current supply conductor carries an amalgam which is provided on a metal plate which is secured to the current supply conductor.

In a favorable embodiment, the amalgam is provided, in the low-pressure mercury vapor discharge lamp, on the segment of the current supply conductor by means of soldering or welding. The amalgam can be readily provided in this manner by touching the region of the current supply conductor to be coated with a "soldering iron", thereby moistening said region with metal from the iron. The so-called "solder tin" contains an amalgam or an amalgam-forming agent, that is an amalgam-forming metal such as indium, tin, lead or bismuth, or an amalgam-forming alloy, for example of lead and tin or of bismuth and indium. In the latter case, the amalgam on the current supply conductor may form, for example, by means of mercury vapor from the discharge space of the discharge vessel after the lamp has been provided with its filling. Soldering or welding at the location of the region to be coated can be enhanced by using a flux. If necessary, a region to be coated may be provided first with a layer of another material in order to improve the adhesion of the coating of amalgam or amalgam-forming agent to the current supply conductor. The coating may alternatively be provided, for example, electrolytically. The quantity of amalgam on the relevant region can be readily chosen by those skilled in the art by varying the thickness of the current supply conductor and the length of the region The current supply conductors are made, for example, of iron, nickel, iron-nickel, or chromium-nickel-iron.

Instead of coating the current supply conductors before they are secured to an end portion of the discharge vessel, the current supply conductors may alternatively be coated after said current supply conductors and the end portion have been joined together. Optionally, the coating may be applied to a current supply conductor after the electrode has been secured to said current supply conductor.

A higher run-up rate is already achieved if the discharge lamp carries an amalgam at one of the end portions. In the case of a relatively long discharge vessel, for example longer than 40 cm, it takes a relatively long time for the released mercury vapor to spread in the discharge space enclosed by the discharge vessel. In this case, it is favorable to provide both end portions of the discharge vessel with an amalgam.

In the customary power supply units of lamps, the lamp current flows mainly through one of the current supply conductors, hereinafter referred to as the current-carrying current supply conductor. Since the discharge arc acts on the electrode at a location where the electrode borders on the relevant current supply conductor, the current-carrying current supply conductor reaches a relatively high temperature. Favorably, this current supply conductor is provided with amalgam. However, it is not always certain beforehand which of the current supply conductors is the current-carrying current supply conductor. This is the case, for example, if the lamp and its power supply unit can be detached from each other and coupled in different manners. In that case, it is favorable if both current supply conductors are provided with amalgam.

Apart from one or more amalgams which serve as an auxiliary amalgam, the lamp may also comprise one or more amalgams which serve as the main amalgam, that is amalgams which determine the vapor pressure of the mercury in the discharge space during nominal operation. For example, a main amalgam is arranged in an exhaust tube of the discharge vessel. A main amalgam may however be absent. In this case, the mercury vapor pressure in the discharge vessel is determined by the mercury vapor pressure associated with the coldest spot of the discharge vessel.

These and other aspects of the invention will be apparent from and elucidated with reference to the embodiments described hereinafter.

DETAILED DESCRIPTION OF THE PREFERRED EMBODIMENTS

Figure 1:
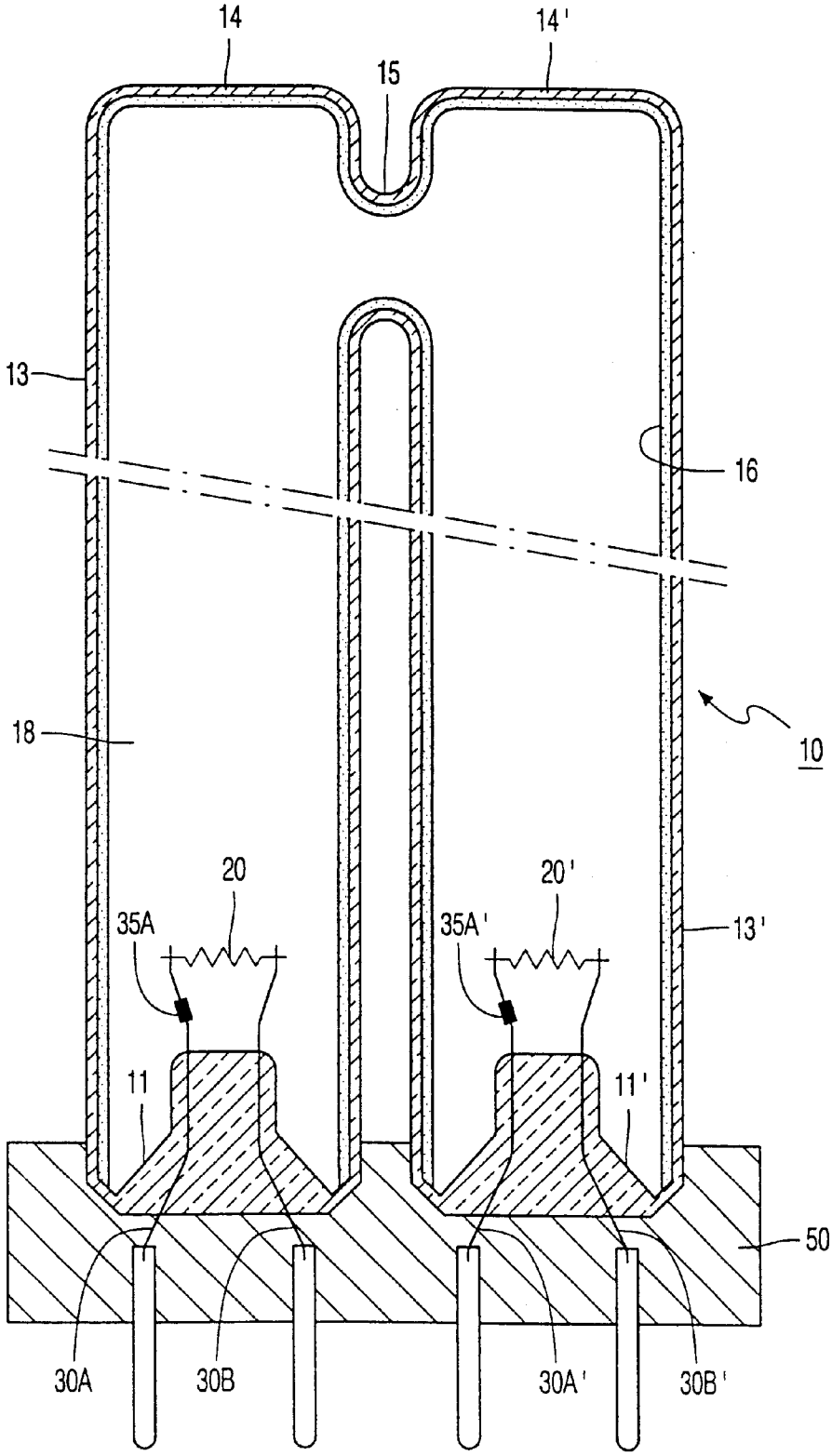
FIG. 1 is a cross-sectional view of an embodiment of the low-pressure mercury vapor discharge lamp in accordance with the invention.

The Figures are purely schematic and not drawn to scale. Particularly for clarity, some dimensions are exaggerated strongly. In the Figures, like reference numerals refer to like parts whenever possible.

FIG. 1 shows a low-pressure mercury vapor discharge lamp comprising a tubular discharge vessel 10 with (glass) end portions 11; 11'. The discharge vessel 10 encloses, in a gastight manner, a discharge space 18 containing an ionizable filling including, apart from 3 mg mercury, an inert gas, for example a 75/25 mixture of argon and neon. In the embodiment shown, the discharge vessel 10 comprises two tube portions 13; 13' which each have an end portion 11; 11'. Said end portions 11; 11' are jointly fixed in a lamp cap 50. At the location of tube ends 14; 14' situated opposite the lamp cap 50, the tube portions 13; 13' are in communication with each other via a channel 15. The discharge vessel may alternatively be embodied so as to be, for example, a single stretched, or bent, tube, for example a tube bent in the form of a hook. The discharge vessel 10 is provided, on a side facing the discharge space 18, with a luminescent layer 16. At each end portion 11; 11', an electrode 20; 20' is arranged in the discharge space 18. Alternatively, an outer electrode may be arranged at an end portion of the discharge vessel to create a capacitive coupling with a power supply unit of the lamp. Current supply conductors 30A, 30B; 30A', 30B' extend from the electrodes 20, 20' through the end portion 11; 11' so as to project from the discharge vessel 10. At least one current supply conductor 30A carries an amalgam. In the embodiment shown, also the current supply conductor 30B carries an amalgam.

Figure 2:
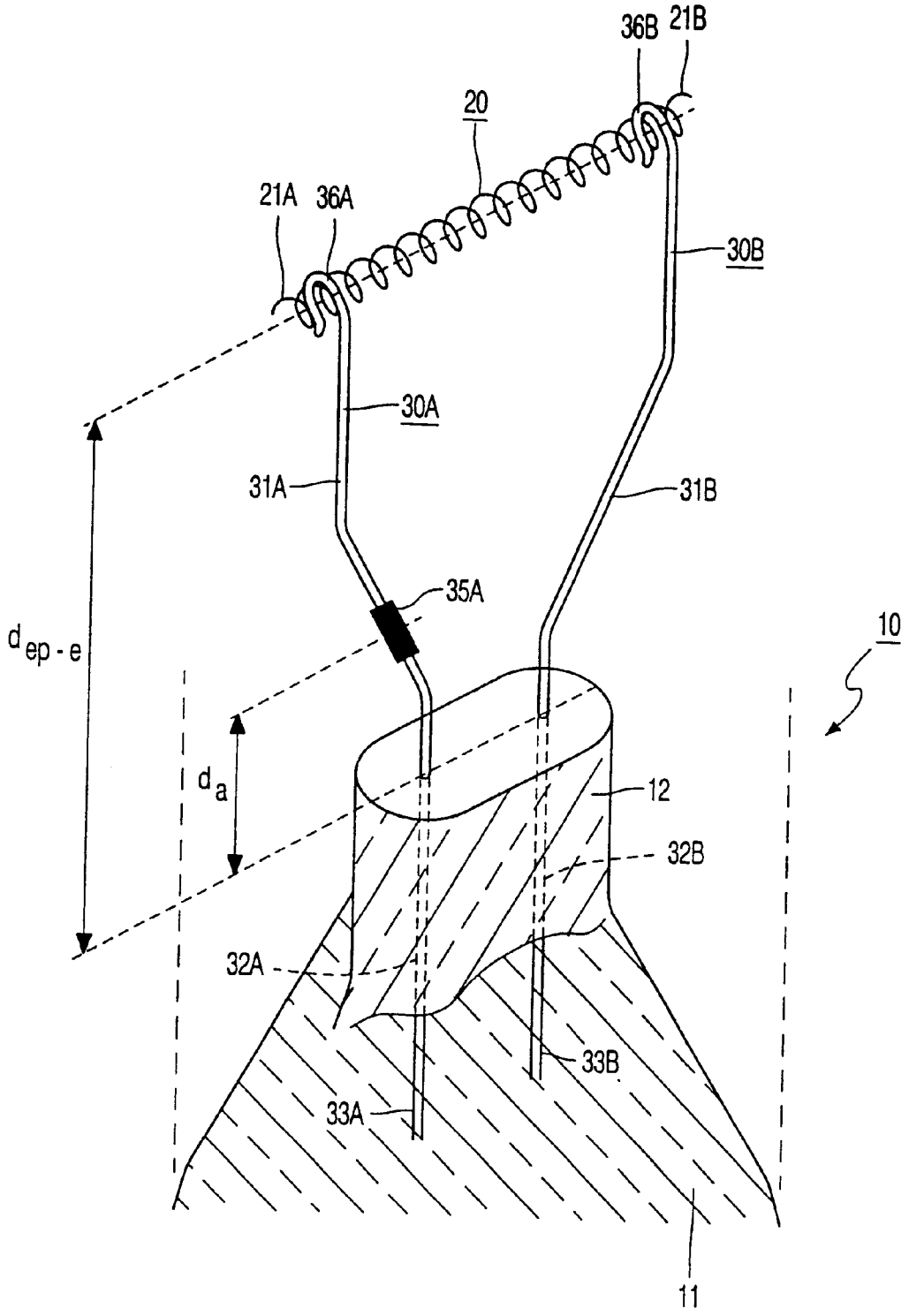
FIG. 2 is a perspective view of a detail of the discharge lamp shown in FIG. 1.

FIG. 2 is a perspective view of a detail of the discharge lamp shown in FIG. 1. In FIG. 2, the discharge lamp 10 is indicated by dashed lines. The amalgam, in this example lead-tin-mercury, covers a region 35A of the current supply conductor 30A, which connects the end portion 11 to the electrode 20. In FIG. 2, the amalgam is provided on a segment 31A of the current supply conductor 30A, which segment 31A extends between the end portion 11 and the electrode 20. For clarity, in FIGS. 1 and 2, the regions 35A; 35A' are dark with respect to the rest of the current supply conductors 30A, 30B; 30A', 30B'. The regions 35A; 35A' each are approximately 3 mm in length and provided with a coating having a thickness of 1 mm. The quantity of lead-tin in each region is approximately 15 mg. In FIG. 2, the current supply conductors 30A, 30B have a first segment 31A, 31B of iron wire with a thickness of 0.6 mm, a second segment 32A, 32B of NiFeCuMn-wire with a thickness of 0.35 mm, and a third segment 33A, 33B of CuSn-wire with a thickness of 0.4 mm which extend, respectively, predominantly in the discharge vessel 10, in a wall 12 of the end portion 11 of the discharge vessel 10, and outside the discharge vessel 10 (see FIG. 2, in which the second segments 32A, 32B are indicated by dashed lines). At the end portion 11', the lamp is similarly constructed (not shown in FIG. 2).

The electrode 20; 20' is a winding of tungsten which is covered with an electron-emitting substance, in this case a mixture of barium oxide, calcium oxide and strontium oxide. The electrode 20; 20' comprises a winding which, at both ends 21A, 21B, is clamped in a curve 36A, 36B of respective current supply conductors 30A, 30B.

In the embodiment shown in FIGS. 1 and 2, the current supply conductors 30A, 30B; 30A', 30B' each comprise such an auxiliary amalgam-coated region 35A, 35B at both end portions 11, 11 ' of the discharge vessel 10. For clarity, the construction of the end portions is not shown in detail in FIG. 1.

In FIG. 2, the amalgam is at a distance $d_a$ from the end portion 11, where $d_a>0$. As indicated in FIG. 2, the distance $d_a$ is measured from the end portion 11 to the center of the amalgam. The distance from the end portion 11 to the electrode 20 is indicated, in FIG. 2, by $d_{ep-e}$, which distance is measured from the end portion 11 to the center of the electrode 20 (see FIG. 2). In accordance with a favorable embodiment of the invention, the distance $d_a$ meets the relation:

$$0.1\times d_{ep-e}\leqq d_a\leqq 0.5\times d_{ep-e}.$$

A particularly suitable value for the distance $d_a$ is $d_a\approx 0.2\times d_{ep-e}$.

In the course of the manufacture of the lamp, after the current supply conductors 30A, 30B; 30A', 30B' and the end portions 11, 11 ' of the discharge vessel 10 have been joined together, said end portions can be brought into contact with a soldering iron which contains the amalgam or the amalgam-forming agent, the current supply conductors being provided with the amalgam or amalgam-forming agent over the length of the region to be coated. It is alternatively possible to provide the coating of the amalgam or amalgam-forming agent on the current supply conductors before said current supply conductors and the end portion of the lamp are joined together. The electrode can be connected to the current supply conductors in the customary manner by bending each of the current supply conductors about an end portion of the electrode. The end portions of the discharge vessel and the tubular part of the discharge vessel can subsequently be fused together, whereafter the discharge vessel is rinsed, cleaned and provided with its filling by means of an exhaust tube (not shown). If the current supply conductors are coated with an amalgam-forming agent, this agent can form an amalgam with mercury from the filling. Suitable amalgam-forming metals are indium, tin, lead and bismuth. Suitable amalgam-forming alloys are lead and tin, and bismuth and indium.

Well-known low-pressure mercury vapor discharge lamps and discharge lamps in which a Pb-Sn amalgam is directly applied to a segment 31A of the current supply conductor 30A, which extends between the end portion 11 and the electrode 20, are subjected to life tests. In these tests, the above-mentioned discharge lamps are aged, both "base-up" and "base-down, at a rotated voltage of 230 V (at a mains voltage of 50 Hz). The light-technical and electrical data are measured after 0, 24, 100, 2000, 5000 and 10,000 hours. The known discharge lamps exhibit a lower light output than the discharge lamps in accordance with the invention. The light output of the known discharge lamps is, on average, 90% after 500 hours, while the light output of the discharge lamps in accordance with the invention is, on average, 95%. After 10,000 hours, the light output is, respectively, 85% and 90%. In either case the light output after 100 burning hours is assumed to be 100% (reference). The time necessary for reaching the rated light output of the discharge lamp is expressed by means of the so-called "run-up" time, which is the period of time within which the discharge lamp reaches 80% of its maximum light output. If the run-up time after 100 hours is assumed to be 100% (reference), the run-up time of the known discharge lamp after 5000 hours is 95%, and the run-up time of the discharge lamp in accordance with the invention is 140%. After 10,000 hours, the "run-up" time of the known discharge lamp is 160% and the run-up time of the discharge lamp in accordance with the invention is 280%. By the measure in accordance with the invention, a low-pressure mercury vapor discharge lamp of the type described in the opening paragraph is provided which reaches its rated light output more rapidly. By providing the amalgam directly onto the segment 31A of the current supply conductor 30A, the discharge lamp can be manufactured more economically.

It will be obvious that within the scope of the invention many variations are possible to those skilled in the art.

The scope of the invention is not limited to the embodiments. The invention is embodied in each new characteristic and each combination of characteristics. Any reference signs do not limit the scope of the claims. The word "comprising" does not exclude the presence of other elements or steps than those listed in a claim. Use of the word "a" or "an" preceding an element does not exclude the presence of a plurality of such elements.

What is claimed is:

1. A low-pressure mercury discharge lamp comprising a discharge vessel (10) having end portions (11, 11'), which discharge vessel (10) encloses a discharge space (18) containing a filling of mercury and an inert gas in a gastight manner, an electrode (20, 20') arranged at each end portion (11, 11') for generating and maintaining a discharge in the discharge space (18), current supply conductors (30A, 30B, 30A', 30B') of the electrodes (20,20') extending through the end portions (11, 11') so as to project from the discharge vessel (10), and at least one of the current supply conductors (30A, 30B, 30A', 30B') carrying an amalgam, characterized in that:

said amalgam constituting all amalgam present in the discharge space (18)

all of the amalgam directly coats a region (35A, 35A') of a segment (31A, 31A') of the current supply conductors (30A, 30B, 30A', 30B'), which segment (31A, 31A') connects the end portions (11, 11') to the electrode (20, 20'), and which region (35A, 35A') is situated at a distance ($d_a$) from the end portion (11, 11') where $d_a>0$.

2. A low-pressure mercury vapor discharge lamp as claimed in claim 1, wherein the distance $d_a$ meets the relation:

$$0.05\times d_{ep-e}\leqq d_a\leqq 0.9\times d_{ep-e},$$

where $d_{ep-e}$ is a distance between the end portion (11; 11') and the electrode (20; 20'), the distance $d_a$ being measured from the end portion (11; 11').

3. A low-pressure mercury vapor discharge lamp as claimed in claim 2, wherein the distance $d_a$ meets the relation:

$$0.1\times d_{ep-e}\leqq d_a\leqq 0.5\times d_{ep-e}.$$

4. A low-pressure mercury vapor discharge lamp as claimed in claim 1 or 2, wherein the amalgam is provided directly on the segment (31A) of the current supply conductor (30A, 30B; 30A', 30B').

5. A low-pressure mercury vapor discharge lamp as claimed in claim 4, wherein the amalgam is provided on the segment (31A) of the current supply conductor (30A, 30B; 30A', 30B') by means of soldering or welding.

6. A low-pressure mercury vapor discharge lamp as claimed in claim 1, wherein the segments (31A) of the current supply conductors (30A, 30B; 30A', 30B') each have an amalgam-coated region (35A; 35B) at least at an end portion (11; 11') of the discharge vessel (10).

7. A low-pressure mercury vapor discharge lamp as claimed in claim 1, wherein the amalgam comprises a material selected from the group formed by indium, tin, lead and bismuth and by combinations of these materials.

* * * * *